United States Patent [19]

Wagner

[11] 3,949,585

[45] Apr. 13, 1976

[54] PROCESS FOR COOLING ROLLED WIRE

[75] Inventor: Manfred Wagner, Elstorf, Germany

[73] Assignee: Hamburger Stahlwerke GmbH, Hamburg, Germany

[22] Filed: Apr. 22, 1975

[21] Appl. No.: 570,992

[30] Foreign Application Priority Data

Apr. 22, 1974 Germany ..... 2419345

[52] U.S. Cl. ..... 72/201

[51] Int. Cl.[2] ..... B21B 27/10; B21B 45/02

[58] Field of Search ..... 72/45, 200, 201, 202, 342, 72/364

[56] References Cited

UNITED STATES PATENTS

| | | | |
|---|---|---|---|
| 1,931,912 | 10/1933 | Whitzel | 72/201 |
| 2,856,803 | 10/1958 | Fredriksson et al. | 72/201 |
| 3,766,763 | 10/1973 | Cofer et al. | 72/201 X |
| 3,881,337 | 5/1975 | Cofer et al. | 72/201 X |

*Primary Examiner*—C. W. Lanham
*Assistant Examiner*—E. M. Combs
*Attorney, Agent, or Firm*—Watson, Cole, Grindle & Watson

[57] ABSTRACT

In a process for cooling rolled wire a coolant tube is mounted directly behind a pair of grooved rollers used to roll wire stock into wire, the coolant being introduced into the tube in a direction opposite the direction of wire movement through the tube. The tube is provided with an inlet at a spaced distance from the rollers, and coolant supply bores are provided on the tube in communication with the inlet. Coolant under a pressure at more than 5 atmospheres is introduced through the bores in a direction toward the rollers to thereby cool the rolled wire. The coolant issuing from an end of the tube adjacent the rollers likewise serves to cool the rollers.

4 Claims, 4 Drawing Figures

PROCESS FOR COOLING ROLLED WIRE

This invention relates generally to a rolled wire cooling process and, more particularly, to such a process wherein coolant is introduced through bores provided in a coolant tube in a direction opposite the direction of movement of the wire through the tube, the coolant being introduced at a pressure at more than 5 atmospheres.

The process in accordance with the present invention, for the cooling of rolled wire, utilizes a cooling pipe for the milled wire disposed directly behind a pair of grooved rollers used for rolling the wire. Coolant is inroduced initially tangentially into the tube in a direction opposite the direction of movement of the wire through the tube, and the coolant issuing from the tube is likewise used for cooling the rollers. The tube is provided with a coolant inlet at a spaced distance from the rollers, and is provided with coolant supply bores to facilitate introduction of the coolant in a direction toward the rollers.

A process of this general type is disclosed in German Pat. applicaton Ser. No. 1,602,172 wherein a coolant tube is provided for both guiding the wire away from the grooved rollers as well as for cooling of the wire. The tube is arranged directly behind the rollers and the coolant issuing from it sprays into the grooves of the rollers. In accordance with such process, the cooling of the roller grooves must be set at precisely the position at which the heating of the wire during the milling process has ended so that substantially the entire roller revolution will be capable of being cooled. Although such a cooling process effects a prolonged service life of the grooved rollers thereby minimizing shutdowns of the wire rolling mill as a result of changing the grooved rollers, it has been found that with the approach taken in accordance with the invention the service life of the grooved rollers can be further prolonged without replacement. An object of the invention is therefore to further develop the known cooling process for cooling rolled wire so as to effect a substantial increase in the service life of the grooved rollers.

In carrying out this objective, the coolant is introduced into the tube at a pressure at more than 5 atmospheres. Despite this relatively high pressure, no breaking out of the rolled stock during rolling was observed, and a considerable improvement of the service life of the grooved rolls was obtained together with an intensive cooling of the rolled stock. In carrying out the process according to the invention, coolant pressures at 10 to 12 atmospheres were applied. Also, in order to increase the cooling effect for the rolled stock it has been found advantageous to apply a torque relative to the rolled stock of the coolant introduced into the coolant supply tube. For such purpose, a coolant tube may be used as having spirally disposed coolant supply bores along the periphery thereof at the inlet end of the tube, such bores being disposed at a small angle to the longitudinal axis of the tube so as to effect a torque for the coolant which smoothly embraces the rolled wire as it moves along such axis in a direction opposite the direction at which the coolant is introduced into the tube.

The tube in accordance with the invention likewise opens into the grooved rollers at an angle of about 26° to 30°.

With the coolant tube of the invention mounted directly at the outlet of the wire from the grooved rollers, the coolant strikes the grooved rollers at such a high velocity that the steam layer which normally develops is avoided and a highly intensive cooling effect is obtained with heat transfer factors of over 5,000 kcal/m$^2$ h° C. By means of such intense cooling, which takes place precisely at the grooves of the rollers, it is possible to avoid heating of the grooves to those high temperatures which normally occur temporarily during rolling.

Heretofore, the rollers have generally not been cooled at the position at which they come in contact with the hot wire which often exceeds 1,000° C. Coolant sprayed from nozzles mounted somewhat above the rollers has practically no velocity of flow at the intake position of the wire and therefore develops only a negligible cooling effect at such position. The rollers can as a result heat up to very high temperatures at the point of contact with the hot wire, although the temperature peak can be relatively quickly reduced by conducting the heat out of the grooved rolls. These temperature peaks, however, obviously serve to weaken the grooved rolls. Such can be substantially avoided if the coolant is sprayed at a high velocity into the grooves between the rollers as in accordance with the invention so as to thereby greatly reduce the temporary heating up of the rolled material.

The coolant supply bores of the tube in communication with the inlet are, in accordance with the invention, evenly distributed along the periphery of the tube and are disposed at a small angle to the tube axis, i.e, at an angle of about 5° to 9°. Such an arrangement serves to avoid a breaking out of the wire, or any unnecessary disturbance of the wire while either moving along the tube or at the point of contact with the grooved rollers, by reason of an otherwise high flow-through resistance caused by high pressure of the coolant. The inner cross-section of the cooling tube is therefore made about 21 percent larger than that of the rolled wire. Also, the cooling tube is preferably of a length of not more than 400 mm.

The above objects and advantages of the present invention will become more apparent from the following description of the invention when taken in conjuncton with the accompanying drawings wherein.

Figure 1:
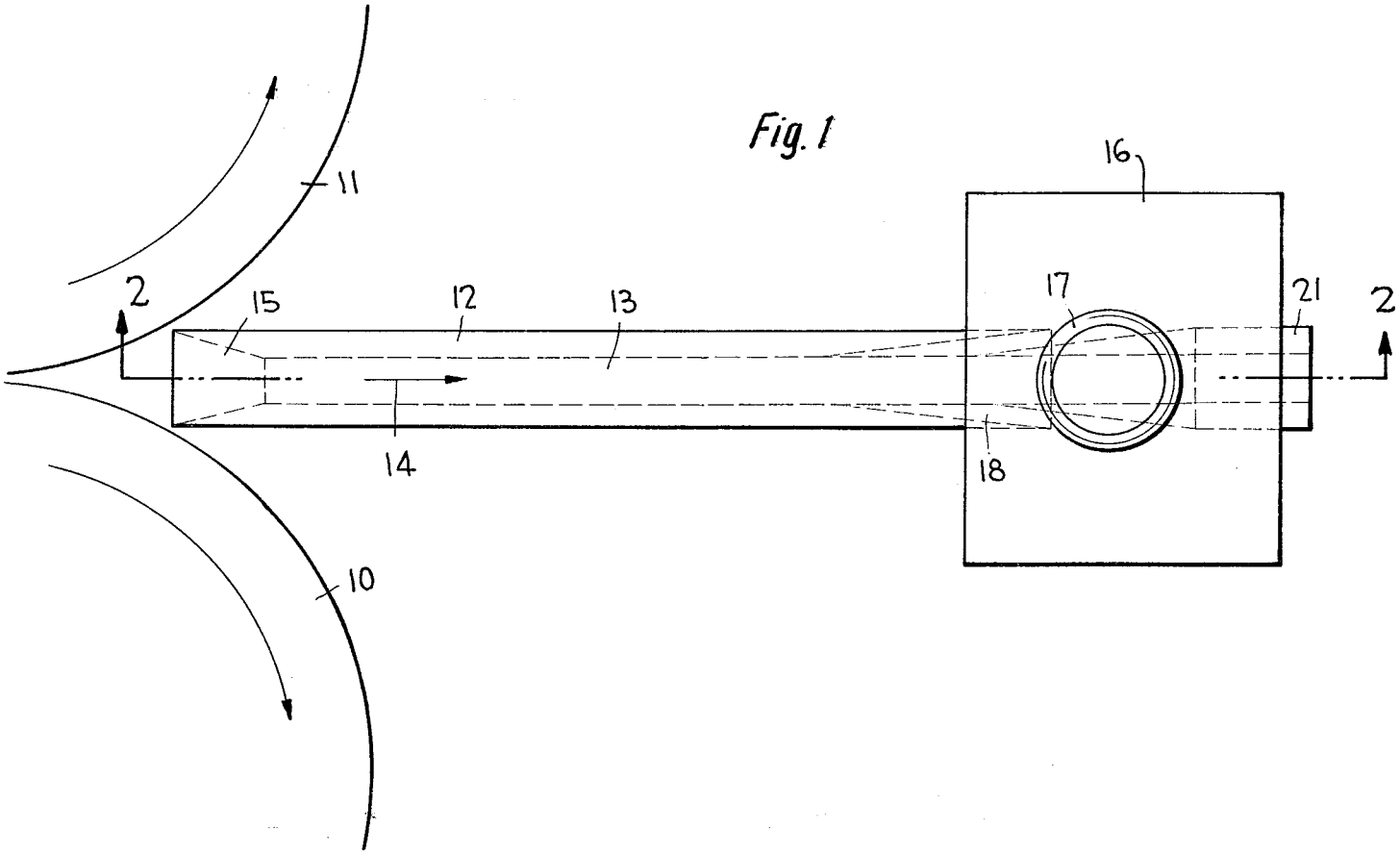
FIG. 1 is a side elevational view of a wire rolling apparatus with a ducted cooling tube according to the invention.

Turning now to the drawings wherein like reference characters refer to like and corresponding parts throughout the several views, FIG. 1 shows in part a pair of grooved rollers 10 and 11 of an apparatus used in the making of wire by rolling the wire in any conventional manner between these rollers. An open-ended ducted cooling tube 12 is disposed slightly behind the gap between the rollers for the purpose of cooling the wire as it is guided therethrough in a direction shown by arrow 14.

The tube has a central through bore 13 along its longitudinal axis, which bore terminates in a funnel-shaped entry opening 15 for the wire. The inner wall of this opening lies at an angle of about 26° to 30° to the longitudinal axis of the tube.

An inlet housing 16 (see also FIGS. 2 and 3) is located near an end of the tube at a spaced distance from the rollers. An open sleeve 17 on the housing is connected to a source (not shown) of coolant for inroducing coolant under pressure into the tube.

The tube is provided with a plurality of coolant supply bores 18 along the periphery thereof so as to extend through the tube wall into central bore 13 from an inlet end 19 whereby the central bore is in communication with the interior of housing 16. These bores 18 are disposed at angles to the longitudinal axis of the tube of about 5° to 9° so that the coolant initially enters the tube tangentially to the wire. Tube 12 also has a section 21 which extends outwardly of inlet housing 16, this section having a conical outer surface of an angle corresponding to the angled disposition of bores 18. Accordingly, the rolled and cooled wire, moving along central bore 13 may pass out through section 21.

Figure 2:
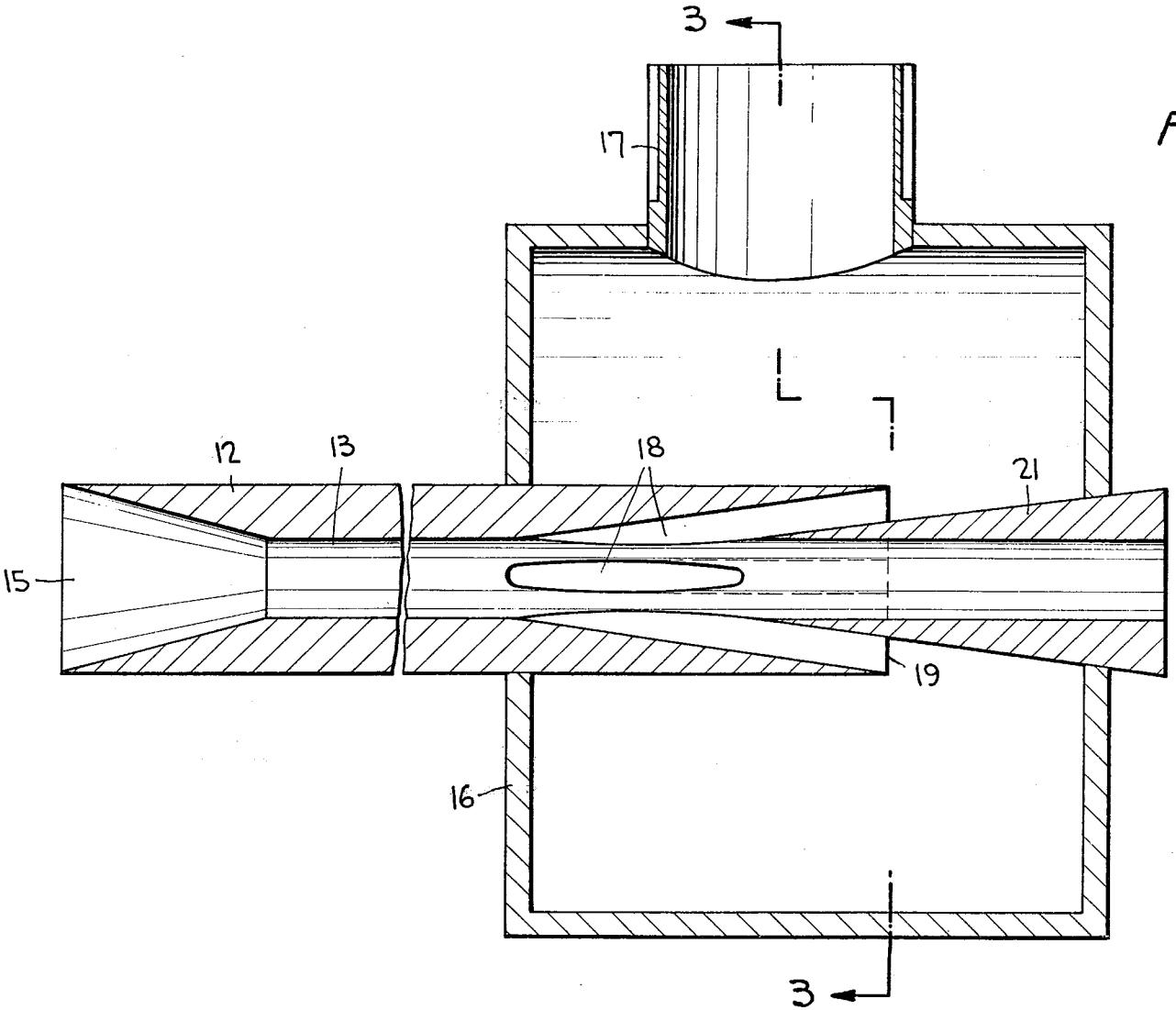
FIG. 2 is a longitudinal sectional view of the ducted cooling tube and inlet housing taken substantially along line 2—2 of FIG. 1.
Figure 3:
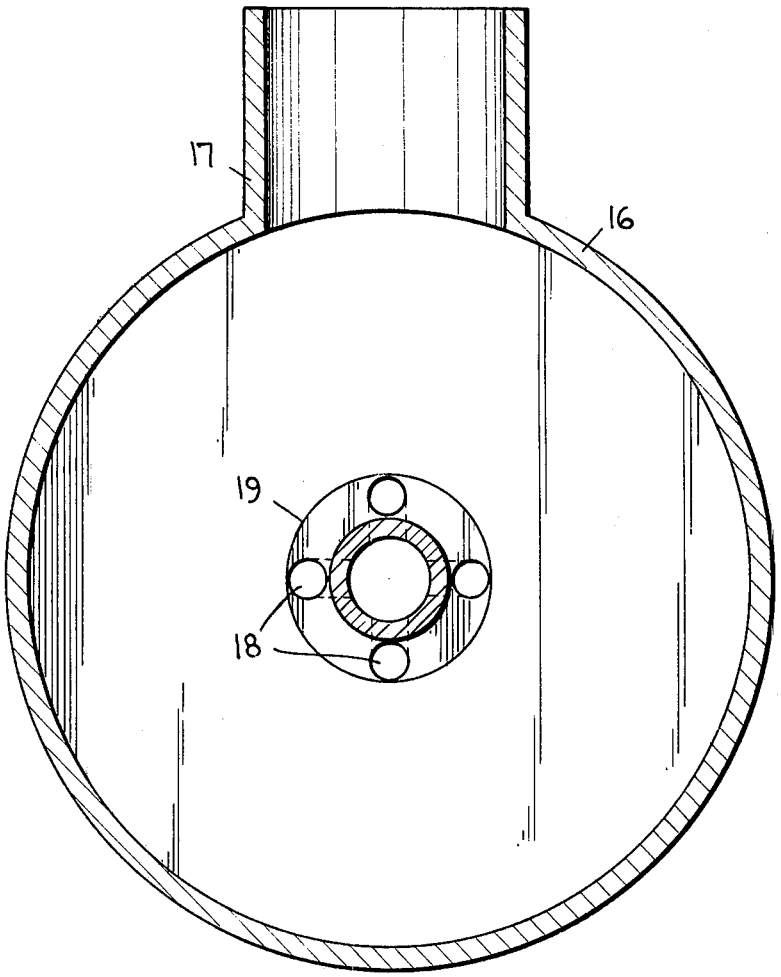
FIG. 3 is a sectional view taken substantially along line 3—3 of FIG. 2.
Figure 4:
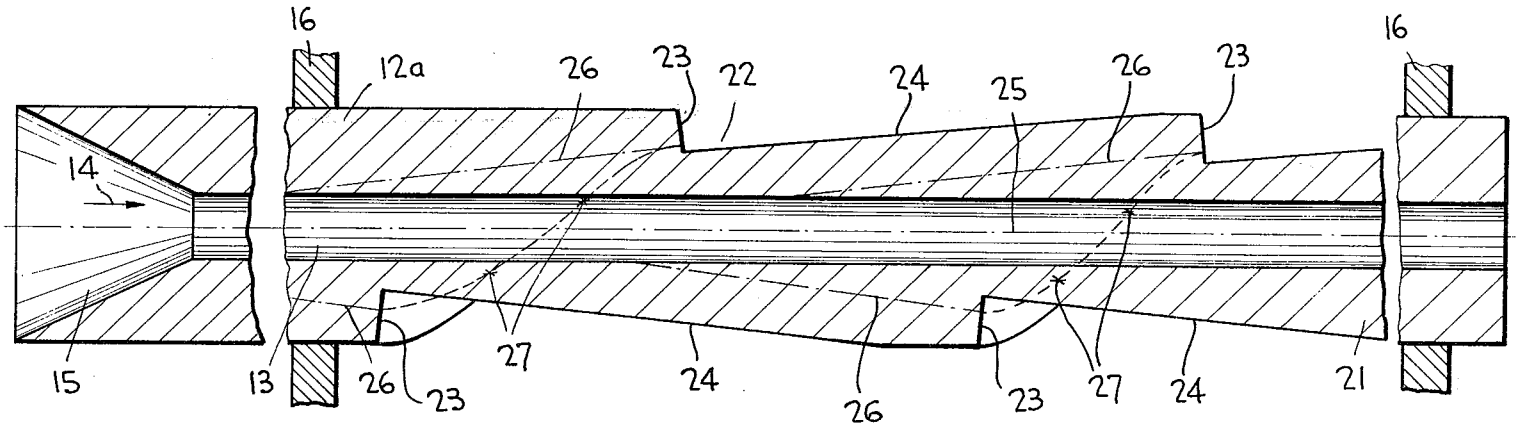
FIG. 4 is a longitudinal sectional view taken through another embodiment of a ducted cooling tube in accordance with the invention.

FIG. 4 is a view similar to FIG. 2 except that another embodiment of a ducted tube 12*a* is shown with its coolant supply bores in communication with the interior of inlet housing 16 shown partly broken away. In this embodiment the tube is provided with a spiral-shaped groove 22 formed along the outer surface thereof wherein each turn of the spiral is spaced about 10 cm from one another. The groove defines a continuous shoulder 23 substantially perpendicular to surface 24. Coolant supply bores 18 extend from the spirally disposed shoulder 23 and open into central bore 13 at angles to longitudinal axis 25 similarly as described for the afore-described embodiment. Bores 18 are not shown as such in FIG. 4 in the interest of clarity; instead, their center lines 26 show their relative dispositions as well as inlet points 27 thereof indicating that the coolant supply bores are slightly staggered so that a torque is effected for the coolant about the wire to be cooled which moves through central bore 13 in the direction of arrow 14. Also, surface 24, which defines spiral groove 22 together with shoulder 23, is disposed at substantially the same angle to axis 25 as that of the coolant supply bores 18. In this construction, eight bores 18 communicate with the interior of inlet housing 16 and extend from spiral groove 22 into central bore 13 of the cooling tube and are disposed at equal distances from one another. When the coolant inletting through bores 18 are given a torque as in the manner described, it is practical to arrange a series of bores extending from groove 22 in order to assure introduction of the coolant as uniform as possible over the entirety of the wire to be cooled. Also, because of the intensive cooling of the surface of the rolled wire, which is particularly effected by means of the coolant supplied with a torque, the rolled wire moves through the downstream rollers with a reduced surface temperature thereby resulting in an increased service life for these downstream rollers.

The device according to FIG. 2 was constructed and experimented with by locating the ducted cooling tube 12, of a length of 400 mm, behind the last rack of the finishing separate roller line of a two-stranded continuous rolling mill similarly as shown in FIG. 1. The open end 15 of the tube was spaced at 66 mm from the middle of the rollers which had a roll diameter of 285 mm.

Coolant was introduced into the tube through bores 18 at a pressure of 10 atmospheres. The wire rolled by the rollers and entering the tube was of a quality D65 with a 5.5 mm outer diameter and of a composition 0.65% C, 0.25% Si and 0.53 % Mn. The delivery speed of the last rack of rollers was at 41 meters per second. The exit temperature of the wire leaving the rollers was about 1140° C without the use of coolant, and the temperature thereof was reduced to about 1180° C with the coolant using the device as aforedescribed. On being cooled off an unusually high heat transfer factor $x$ in the ducted cooling tube of $x = 25{,}000$ kcal/h $m^2$ resulted so that, for the entire cooling, only the heat conductivity of the wire is substantially decisive. The rollers were of the usual cast iron composition normally having a life span of 90 tons per groove for a wire quality of D65. The durability on cooling the rollers amounted to 190 tons per groove using the cooling arrangement as aforedescribed. On the other hand, by introducing coolant into the tube at 2 atmospheres pressure, a durability of 110 tons per groove resulted. Although with the ducted cooling tube mounted at a distance of 150 mm from the middle of the rollers, which is at approximately twice the distance as described above, and with a coolant pressure of 10 atmospheres applied, the durability of the rollers was likewise 110 tons per groove.

During further experimentation with the FIG. 2 arrangement, a serrated wire of a quality III*a* of 6 mm outer diameter was cooled at a water pressure of 10 atmospheres. The composition of the wire was 0.38% C, 0.25% Si and 0.93% Mn. It left the last rack of the mill with a delivery speed of the rollers at 36 meters per second and at a temperature of 1080° C with the cooling operation switched off. After switching on the cooling operation, the temperature of the wire leaving the rollers was reduced to 1030° C. In spite of the serrations, which severely complicate the water cooling effect because of the continuous high resistance thereby effected, the wire was nevertheless able to be milled free of interference.

The unusually high heat transfer factors occurring, which far exceed that expected for a direct current cooling of the wire, can be explained by the relative speed between the wire and the coolant in the present arrangement. This counter-flow technique avoids the problem of breaking out of the wire which otherwise occurs during other high flow resistance arrangements. By precisely guiding the wire through the ducted tube, with a symmetrical and almost balanced supply of coolant and by preserving the cross-sectional relationship between central bore 13 and the wire, any breaking out problem of the wire is substantially avoided. Moreover, an increased cooling of the wire results.

Also, it was found that the surface of the wire was relatively intensely cooled by the high pressure of the coolant on the relatively short cooled stretch so that the load of the following pair of rollers of another rolling rack is lessened, although the wire nevertheless maintains sufficient heat therethroughout for the following milling process.

Obviously, many modifications and variations of the present invention are made possible in the light of the above teachings. It is therefore to be understood that within the scope of the appended claims the invention may be practiced otherwise than as specifically described.

What is claimed is:

1. Process for the cooling of grooved rollers and wire rolled from wire stock by the rollers, wherein an open-ended hollow cooling tube is mounted directly behind the grooved rollers, comprising, providing an elongated coolant inlet for the tube at a spaced distance from the rollers, providing coolant supply bores evenly distributed along the periphery of the tube and directed toward the rollers and in communication with the inlet, disposing the coolant supply bores at an angle to the longitudinal axis of the tube of between 5° to 9°, and introducing coolant at a pressure of more than 5 atmospheres through the bores in a direction toward the rollers and opposite the direction of movement of the wire through the tube whereby the rolled wire is cooled and the coolant issuing from the tube serves to cool the rollers.

2. The process according to claim 1, further comprising the step of applying a torque to the coolant while being introduced into the tube.

3. The process according to claim 1, further comprising the step of spirally arranging the coolant supply bores along the periphery of the tube and about the longitudinal axis thereof so as to effect a torque application for the coolant while being introduced into the tube.

4. The process according to claim 1, wherein the tube is provided with a length of not more than about 400 mm.

* * * * *